United States Patent [19]

Hayashi et al.

[11] Patent Number: 4,857,429

[45] Date of Patent: Aug. 15, 1989

[54] PROCESS OF IMPROVING OPTICAL CONTACT OF PATTERNWISE POWDERY COATING LAYER AND PHOSPHOR SCREEN PROVIDED THEREFORE

[75] Inventors: Nobuaki Hayashi, Saitma; Shoichi Uchino, Hachioji; Yoshifumi Tomita, Mobara; Saburo Nonogaki, Tokyo; Masahiro Nishizawa, Mobara, all of Japan

[73] Assignee: Hitachi, Ltd., Tokyo, Japan

[21] Appl. No.: 937,425

[22] Filed: Dec. 3, 1986

Related U.S. Application Data

[63] Continuation of Ser. No. 668,017, Nov. 5, 1984, abandoned.

[30] Foreign Application Priority Data

Nov. 7, 1983 [JP] Japan ..... 58-207470

[51] Int. Cl.[4] ..... G03C 5/00; H01J 9/227

[52] U.S. Cl. ..... 430/28; 430/25; 430/29; 430/144

[58] Field of Search ..... 430/28, 29, 25, 144; 427/65

[56] References Cited

U.S. PATENT DOCUMENTS

| | | | |
|---|---|---|---|
| 2,840,470 | 6/1958 | Levine | 430/29 |
| 3,623,867 | 11/1971 | Saulnier | 430/28 |
| 3,966,474 | 6/1976 | Harper | 430/28 |
| 3,981,729 | 9/1976 | Saulnier | 430/28 |
| 3,998,638 | 12/1976 | Griswold et al. | 430/29 |
| 4,089,687 | 5/1978 | Harper | 430/28 |
| 4,094,678 | 6/1978 | Palac | 430/23 |
| 4,100,321 | 7/1978 | Schlesinger et al. | 430/144 |
| 4,273,842 | 6/1981 | Nonagaki et al. | 430/171 |
| 4,276,363 | 6/1981 | Manabe et al. | 430/29 |
| 4,284,694 | 8/1981 | Harper | 430/28 |
| 4,336,319 | 6/1982 | Nagashima et al. | 430/191 |
| 4,391,885 | 7/1983 | Tomita et al. | 430/28 |
| 4,407,916 | 10/1983 | Akagi et al. | 430/28 |
| 4,423,128 | 12/1983 | Koike et al. | 430/28 |
| 4,473,634 | 9/1984 | Dodds et al. | 430/28 |
| 4,485,158 | 11/1984 | Harper | 430/28 |
| 4,513,024 | 4/1985 | Morita et al. | 427/65 |

*Primary Examiner*—Charles L. Bowers, Jr.
*Attorney, Agent, or Firm*—Antonelli, Terry & Wands

[57] ABSTRACT

An optical contact of a patternwise powdery coating layer is improved by permeating a substantially transparent inorganic material having a refractive index of 1.2 to 2.0 into a paternwise powdery coating layer formed on a substrate, thereby forming a mixture layer of the transparent inorganic material and the powdery coating layer between the patternwise powdery coating layer and the substrate.

6 Claims, 3 Drawing Sheets

PROCESS OF IMPROVING OPTICAL CONTACT OF PATTERNWISE POWDERY COATING LAYER AND PHOSPHOR SCREEN PROVIDED THEREFORE

This application is a continuing application of Ser. No. 668,017, filed Nov. 5, 1984, now abandoned.

BACKGROUND OF THE INVENTION

This invention relates to a process for improving an optical contact between a patternwise powdery coating layer and a substrate, and to a phosphor screen provided according to the present process.

The phosphor screen of a color picture tube has been so far prepared through steps of forming a mixture layer of phosphor powders and photosensitive resin on the inner surface of a face plate, a light exposure, development, and drying. Thus, the phosphor powders are bonded to the substrate while being covered with the photosensitive resin insolubilized by light exposure. The photosensitive resin is removed by panel baking, after a metal back layer made of aluminum vapor-deposited film has been formed on the back side of the phosphor layer. Consequently, a space having at least a depth corresponding to the thickness of the insolubilized photosensitive resin is formed between the phosphor powders and the glass surface of the face plate.

In the conventional phosphor layer structure, a portion $R_1$ of fluorescence L generated within phosphor 1 by impingement of electron beams is reflected on the surface of phosphor 1, and the fluorescence L transmitted through the surface of phosphor 1 proceeds in vacuum, as shown in FIG. 1. Then, a portion $R_2$ of the transmitted fluorescence L is reflected on the inner surface of face plate 2, and then a portion $R_3$ of the fluorescence L transmitted through the inner surface of face plate 2 is again reflected on the outer surface of face plate 2. Thus, a considerable portion of the fluorescence generated within the phosphor 1 is removed by reflections in the course of passage to the outside, and a good optical contact has not been obtained between the patternwise powdery coating layer as phosphor layer and the substrate as face plate 2.

SUMMARY OF THE INVENTION

An object of the present invention is to provide a process for improving an optical contact between a patternwise powdery coating layer provided on a substrate, and the substrate, and a phosphor layer provided according to the present process, and particularly to improve an optical contact between a face plate and phosphor in a color picture tube.

To remove the space formed by removing the photosensitive resin, it would be presumable to fill the space with a transparent material having an appropriate refractive index, thereby reducing the portion of fluorescence L removed by the reflections at the individual interfaces, but the space is formed after the panel baking, and thus it has been impossible in the ordinary process to fill the space with a transparent inorganic material after the formation of phosphor coating layer, and it has been difficult to improve an optical contact between the patternwise powdery coating layer and the substrate.

In the present process for improving an optical contact of a patternwise powdery coating layer and a phosphor screen provided according to the same process, a patternwise powdery coating layer formed on a substrate is impregnated with a substantially transparent inorganic material having a refractive index of 1.2 to 2.0 to form a mixture layer of the substantially transparent inorganic material layer and the powdery coating layer between the powdery coating layer and the substrate, thereby improving an optical contact between the patternwise powdery coating layer and the substrate.

The reason why an optical contact can be improved by forming a mixture layer of the transparent inorganic material layer and the powdery coating layer between the powdery coating layer and the substrate will be described below, referring to a case of using phosphor powders and the inner surface of a face plate as a substrate.

Reflectivity R at the interface between two materials having refractive indices $n_1$ and $n_2$, respectively, when light passes across the interface can be represented by the following equation:

$$R=\{(n_1-n_2)/(n_1+n_2)\}^2$$

Transmissivity can be represented by the remainder of the reflectivity, and when light passes across a plurality of interfaces, the total transmissivity can be represented by a product of the transmissivities at the individual interfaces. For example, if it is presumed that the refractive index of phosphor is 2.3, and that of glass is 1.5 while there is no light absorption by the phosphor and the glass, only about 77% of the fluorescence generated in the phosphor in the conventional phosphor structure as shown in FIG. 1 can be transmitted to the outer surface of the face plate by calculation.

The present invention will be described in detail below, referring to the drawings.

DETAILED DESCRIPTION OF THE INVENTION

Figure 1:
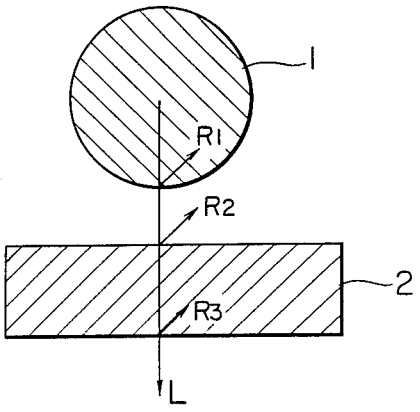
FIG. 1 is a cross-sectional view of the essential part according to the conventional phosphor layer structure.
Figure 2:
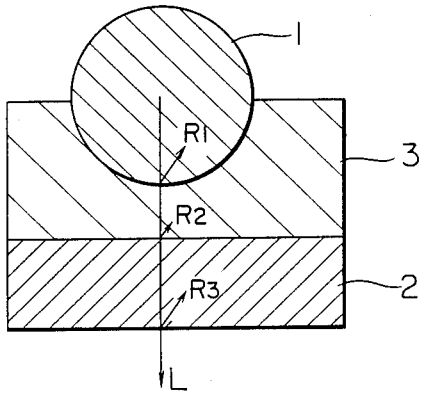
FIG. 2 is a cross-sectional view of the essential part according to one embodiment of the present phosphor layer structure.

FIG. 2 shows a phosphor structure where a substantially transparent inorganic material 3 is filled between phosphor 1 and the inner surface of face plate 2.

Figure 3:
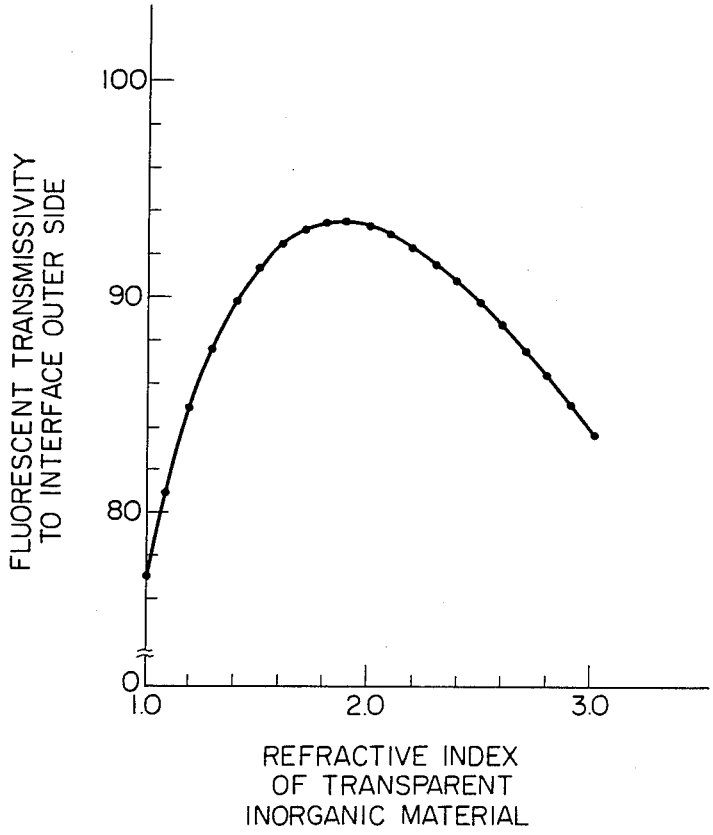
FIG. 3 is a diagram showing relationship between the refractive index of transparent inorganic material filled between the phosphor in the phosphor screen and the inner surface of face plate.

FIG. 3 is a diagram showing changes in transmissivity of fluorescence L transmitted to the outer surface of face plate 2 when the refractive index of the substantially transparent inorganic material 3 is changed from 1.0 to 3.0. As is apparent from FIG. 3, about 91% of fluorescence L generated in phosphor 1 can be transmitted to the outer surface of face plate, when the refractive index of the transparent inorganic material 3 is, for example, 1.5. Since the refractive index of phosphor is presumed to be 2.3, an optical contact between phosphor 1 and face plate 2 can be improved by providing a transparent inorganic material layer having a refractive index of 1.2 to 2.3 between phosphor 1 and face plate 2 according to FIG. 3, and thus the transmissivity of fluorescence L transmitted to the outer surface of face plate 2 can be improved.

The present phosphor screen is also effective for preventing reflections at the individual interfaces, as is given below.

Figure 4:
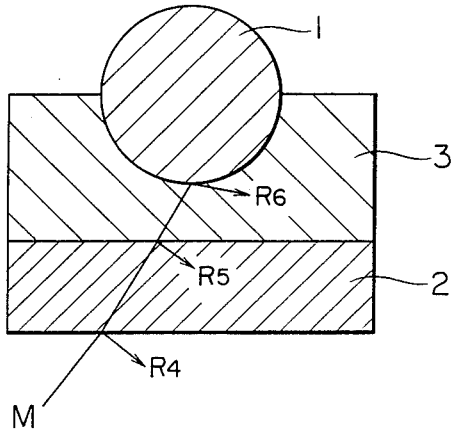
FIG. 4 is a cross-sectional view according to the present phosphor layer structure.

FIG. 4 is a phosphor layer structure according to the present invention, where a portion $R_4$ of the light from outside M is reflected at the outer surface of substrate face plate 2. A portion $R_5$ of the light transmitted into the glass of substrate 2 is reflected at the inner surface of substrate 2. The further transmitted light $R_6$ is reflected at the surface of phosphor particle 1 at random. Both outer surface and inner surface of face plate substrate 2 are smooth, so that the light from outside is reflected as such at both surfaces to form an image, whereas the phosphor is in the form of a very fine particle, and has diversely-oriented surface parts, so that the light is reflected at random at the surface parts and cannot be formed into an image.

Figure 5:
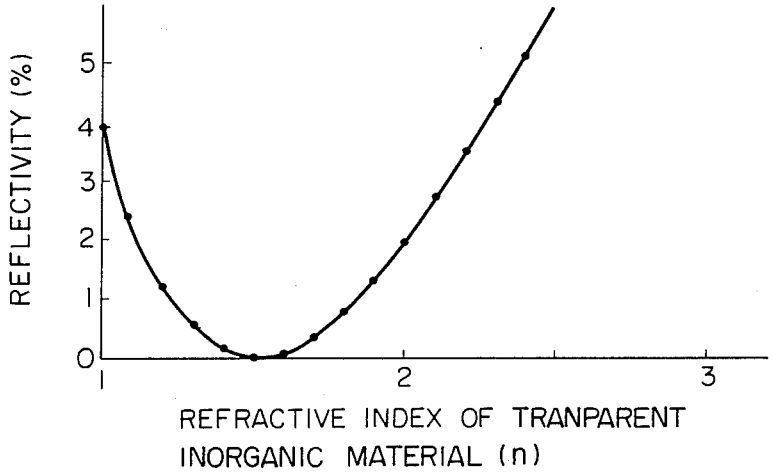
FIG. 5 is a diagram showing relationship between the reflectivity of outside light at interfaces and the refractive index of transparent inorganic material.

FIG. 5 is a diagram showing how large the reflection $R_5$ is at the inner surface of face plate substrate 2 where there is a transparent inorganic material having a refractive index n between the phosphor and the substrate, where the refractive index of the substrate is a glass refractive index of 1.5. As is obvious from FIG. 5, the light from outside can be led to the surface parts of the phosphor particle, if the refractive index of the transparent inorganic material is equal to that of the substrate, and thus there is no reflection at the inner surface of the substrate, so that no outside image can be formed.

In the conventional process for forming a phosphor screen, the phosphor is covered with the insolubilized photosensitive resin until the final step of panel baking, and the transparent inorganic material layer cannot be provided between the phosphor and the face plate, unless the photosensitive layer cured after the formation of phosphor layer is removed, for example, by firing, etc.

Some of the present inventors proposed a process for forming a patternwise powdery coating layer of desired powders on a substrate surface by repeating at least one of the procedure comprising steps of forming a thin layer containing an aromatic diazonium salt capable of becoming tacky by light exposure, on the basis of a finding that the photolytic product of aromatic diazonium compound has a capacity to accept powdery particles, contacting the thin layer with powdery particles, thereby accepting the powdery particles on the tackified portions, and removing excess powdery particles from the thin layer (Japanese patent publication No. 57-20651). In the powdery coating layer formed according to said process, the tackified material is deposited only partly on the powdery particles, and thus all the surfaces of the powdery particles are substantially exposed without being covered with the tackified material. That is, it is possible to impregnate the powdery coating layer with a substantially transparent inorganic material after the formation of the powdery coating layer to form a mixture layer of the powdery coating layer and the transparent inorganic material layer. Thus, the present invention is particularly effective for a case where a powdery coating layer is formed according to said process. A phosphor screen of a color picture tube can be formed by using the inner surface of face plate of a color picture tube as a substrate, and repeating at least once the procedure comprising steps of partial light exposure in a dot or stripe pattern by means of a shadow mask for a picture tube, and depositing phosphor particles onto the light-exposed parts, and an optical contact can be improved between the phosphor and the face plate by impregnating the powdery phosphor layer with a substantially transparent inorganic material, thereby forming a mixture layer of the phosphor powders and the transparent inorganic material between the phosphor layer and the inner surface of the face plate. That is, a color picture tube with a good fluorescence transmissivity can be produced.

Even if the refractive index of the transparent inorganic material to be filled between the powdery coating layer and the substrate exceeds 2.0, a good fluorescence transmissivity can be obtained, as shown in FIG. 3, but the reflection of the light from outside at the glass interface is increased with increasing refractive index, and thus too large a refractive index is not preferable. The refractive index is preferably 1.2 to 2.0, more preferably 1.2 to 1.8.

The substantially transparent inorganic material having a refractive index of 1.2 to 2.0 for use in the present invention includes oxides and hydroxides of Si, Zn, Al, In, Sn, Pb, Ti, and Zr, and can be used alone or in a mixture of at least two thereof.

To form a mixture layer of the powder and the transparent inorganic material between the powdery layer and the substrate after the formation of the powdery layer, it is desirable that the transparent inorganic material initially in a liquid or solution form is mixed into the powdery layer, and then a solid transparent inorganic material is formed. Most of the materials having such characteristics are dielectrics, and include all the materials that are initially not transparent but turn substantially transparent by heating, etc. One example of the transparent inorganic material is an alkali metal silicate, that is, so called water glass. It is also possible to prepare an aqueous solution of a salt of said element and to make the solution alkaline, thereby forming an oxide or hydroxide of said element as the transparent inorganic material. It is also possible to form a mixture layer or an organic salt of said element and the phosphor powders and oxidize the salt at the later stage of panel baking, thereby forming an oxide of said element. To improve the coatability (impregnatability) of the transparent inorganic material or its initial solution, a water-soluble polymer or a surfactant may be added to the transparent inorganic material or the solution.

Practically useful diazonium salts in the phototackified composition for forming a patternwise powdery coating layer in the present invention include stabilized aromatic diazonium salts, for example, aromatic diazonium fluoroborate, aromatic diazonium sulfate, aromatic diazonium sulfonate, aromatic diazonium chloride-zinc chloride double salt, etc. More specific compounds are disclosed in said Japanese patent publication No. 57-20651.

Materials for use in mixture with the diazonium salt include organic polymeric compounds, for example, gum arabic, alginic acid propylene glycol ester, polyvinyl alcohol, polyacrylamide, poly(N-vinylpyrolidone), acrylamide-diacetacrylamide copolymer, etc. as also described in said Japanese patent publication No. 57-20651. These compounds are water-soluble, requiring no organic solvent, and thus are preferable materials for the present invention. They can be used alone or in a mixture of at least two thereof. The purpose of using said polymeric compounds is to improve the coatability in forming a thin layer of the photo-tackifiable composition containing the diazonium salt as a photosensitive component, to improve the uniformity of the thin layer and to control the capacity of the photo-tackifiable thin layer for accepting the powdery particles. When the diazonium salt is used in a mixture with a small amount of the other materials as above, it is preferable to use the other materials in an amount of not more than 5 times the weight of the diazonium salt. To improve the coatability, various surfactants can be added thereto, as desired. It is a well known expedient to add a surfactant to the composition to improve the coatability of the composition, and it is not objectionable to use the surfactants, as in the well known expedients, also in the present invention. It is satisfactory to use about 0.01 to about 1% by weight of the surfactant on the basis of the diazonium salt according to the ordinary procedure.

The present process can be applied not only to the patternwise powdery coating layer formed by said photo-tackifiable composition, but also to a patternwise powdery coating layer formed by coating a substrate with a dispersion of powders and then settling the powders onto the substrate, so far as the powders are not covered by the organic polymer.

The present inventors proposed a process for producing a color picture tube having a black matrix by forming a patternwise powdery coating layer on a substrate as in said Japanese patent publication No. 57-20651, then exposing the entire substrate surface to light, and depositing sintered black powders onto other parts than the parts onto which desired material is deposited. The present invention is also applicable to the color picture tube having the black matrix produced as above. That is, a fluorescence transmissivity to the outer surface of face plate can be improved when the present invention is applied to a color picture tube having the black matrix made of sintered black powders.

Furthermore, the present process for improving an optical contact of a patternwise powdery coating layer can be applied to a black matrix color picture tube whose phosphor layer is formed according to the process of said Japanese patent publication No. 57-20651 on a substrate having a black matrix formed according to the conventional process, for example, the process disclosed in Japanese patent publication No. 52-13913, where the fluorescence transmissivity to the outer surface of the face plate can be also improved.

PREFERRED EMBODIMENTS OF THE INVENTION

The present invention will be described in detail below, referring to Examples.

EXAMPLE 1

An aqueous solution of photo-tackifiable composition as given below was prepared:

| | |
|---|---|
| 4-(dimethylamino)benzene diazonium chloride-zinc chloride | 3.3 g |
| Alginic acid propyleneglycol ester | 0.17 g |
| Deionized water | 97 g |

A glass plate, 6 cm×6 cm, was spin-coated with said aqueous solution at 400 rpm, and dried with hot air to form a film. The film was placed at a position about 50 cm distant from a 500 W ultra-high pressure mercury lamp, and exposed to the mercury lamp light for 40 seconds. Then, blue phosphor was dusted onto the film and deposited thereon, and then the excess phosphor was removed therefrom by air spraying. The screen weight of phosphor was 2.0 to 2.5 mg/cm$^2$. The phosphor-deposited layer was contacted with a vapor mixture of ammonia and water for a few seconds to insolubilize the layer against water. Then, the phosphor screen was spin-coated with a 10% water glass solution, whereby the water glass solution was permeated into the phosphor layer to form a water glass layer in the phosphor layer. The thus prepared phosphor screen was irradiated by ultraviolet light having a wavelength of 254 nm, and the luminance of the fluorescence transmitted to the outer surface of the glass plate was measured. It was found that the luminance was improved by 8%, as compared with that when no water glass was permeated. Furthermore, said phosphor screen was heated in the air at 400° C. for 2 hours, and the luminance was measured in the same manner as above. No change was observed in the luminance, and the luminance was 8% higher than that when no water glass was permeated.

COMPARATIVE EXAMPLE

A phosphor slurry having the following composition was prepared:

| | |
|---|---|
| Blue phosphor | 23 g |
| Polyvinyl alcohol | 2.3 g |
| Ammonium bichromate | 0.2 g |
| Deionized water | 75 g |

A glass plate, 6 cm×6 cm, was spin-coated with said phosphor slurry at 100 rpm and dried in hot air to form a phosphor film having a phosphor screen weight of 2.5 mg/cm$^2$. The phosphor film was placed at a position 50 cm distant from a 500 W ultra-high pressure mercury lamp, and cured by light exposure to the mercury lamp light for 2 minutes. The phosphor film was washed with hot water for one minute and dried, and then spin-coated with a 10% water glass solution in the same manner as in Example 1. However, no water glass solution was permeated into the phosphor layer.

The thus prepared phosphor screen was excited by 254 nm ultraviolet beam, and the luminance of the fluorescence transmitted to the outer surface of glass plate was measured in the same manner as in Example 1. No difference was observed in luminance, when the luminance when the water glass was coated was compared with that when no water glass was coated.

EXAMPLE 2

A blue phosphor film was formed on a glass plate in the same manner as in Example 1, and the phosphor film was fixed by dipping the film in an aqueous 0.1% polyacrylamide solution and thoroughly washed with water. The thus prepared phosphor screen was spin-coated with the same water glass solution as in Example 1, and dried in hot air. After the drying the phosphor screen was irradiated by ultraviolet light in the same manner as in Example 1, and the luminance of the fluorescence transmitted to the outer surface of the glass plate was measured, whereby it was found that the luminance was 10% increased, as compared with that when no water glass was coated.

EXAMPLE 3

A blue phosphor film was formed in the same manner as in Example 2, and fixed by the aqueous polyacrylamide solution and washed with water. The phosphor layer was spin-coated with an aqueous 10% zinc chloride solution, and contacted with a vapor mixture of ammonia and water without drying, whereby a zinc hydroxide layer was formed. Then, the phosphor screen was excited with the ultraviolet beam in the same manner as in Example 1, and the luminance of the phosphor screen was measured. An increase by 4% in the luminance was observed when the aqueous zinc chloride solution was used, as compared with that when no such coating was used.

EXAMPLE 4

A green phosphor film was formed in the same manner as in Example 2 by fixing it with an aqueous 0.1% polyacrylamide solution, and spin-coated with an aqueous 10% indium chloride solution and then contacted with a vapor mixture of ammonia and water. The phosphor screen was excited with ultraviolet light, and the luminance of the phosphor screen was measured. It was found that the luminance was 4% increased when the aqueous indium chloride solution was applied, as compared with that when no such coating was carried out, as in Example 3.

EXAMPLE 5

A phosphor film was prepared in the same manner as in Example 2, except that a solution mixture containing 10% water glass and 2% polyvinyl alcohol was used in place of the water glass solution, and the luminance of the thus prepared phosphor screen was measured in the same manner as in Example 2. It was found that the luminance was 5% increased when the solution mixture of water glass and polyvinyl alcohol was applied, as compared with that when no such coating was carried out. Furthermore, after the coating with the solution mixture of water glass and polyvinyl alcohol and successive drying, polyvinyl alcohol was removed from the phosphor screen by thorough water washing, and the luminance of the phosphor screen was measured. It was found that the luminance was 5% increased when the solution mixture was applied, as compared with that when no such coating was carried out.

EXAMPLE 6

A phosphor dispersion having the following composition was prepared:

| | |
|---|---|
| Green phosphor | 20 g |
| Water glass | 1 g |
| Deionized water | 80 g |

The phosphor dispersion was extended on a glass plate, 6 cm×6 cm, by brushing, and settled for one minute, and then the remaining dispersion is centrifugally removed by revolving the glass plate at 100 rpm. Then, the glass plate was dried in hot air to form a phosphor film. The phosphor film was spin-coated with a 20% water glass solution and dried, and then excited with ultraviolet light. The luminance of fluorescence transmitted to the outer surface of the glass plate was measured. It was found that the luminance was 5% increased in the phosphor film coated with the water glass solution, as compared with that in the phosphor film with no such coating.

EXAMPLE 7

The inner surface of a face plate for a 6-inch color picture tube was spin-coated with a photo-tackifiable composition prepared in the same manner as in Example 1 at 120 rpm and dried with infrared rays to form a film. Then, a shadow mask was provided thereon, and parts corresponding to blue color were exposed to ultraviolet light from an ultra-high pressure mercury lamp as a light source. After the removal of the shadow mask therefrom, blue phosphor powders were dusted onto the film to form a blue phosphor film. By repetitions of the foregoing procedure, the parts corresponding to green color and red color were exposed to the light and green and red phosphor powders were deposited thereon, respectively, whereby a phosphor film of three colors, e.g. blue, green and red, was formed. The phosphor film was fixed with an aqueous 0.1% polyacrylamide solution, washed with water, and dried.

Then, the phosphor film was spin-coated with a 10% water glass solution. The water glass permeated into the phosphor layer to form a water glass layer in the phosphor layer. Then, filming and aluminum vapor deposition were carried out according to the ordinary procedure and then panel baking was carried out at 400° C. for two hours.

A color picture tube was prepared with the thus prepared phosphor screen, and the luminance was measured. It was found that the luminance was 4% increased in the color picture tube with the coated phosphor screen, as compared with that in the color picture tube with the non-coated phosphor screen.

The lesser increase in the luminance than that of Example 1 was due to the fact that the phosphor layer was thicker than that of Example 1, and the water glass layer was formed so thinly at the contact side of the phosphor layer and the substrate, that the optical contact was partly not obtained in the phosphor directly irradiated by electron beams.

The reflectance of the light from outside at the inner surface of face plate could be reduced to 1/5 of that when no coating was carried out.

In the present process for improving an optical contact of a patternwise powdery coating layer and a phosphor screen provided according to the present process, the reflectances of light at the individual interfaces such as powder surfaces, substrate inner surface, substrate outer surface, etc. can be reduced by impregnating the patternwise powdery coating layer formed on the substrate with a substantially transparent inorganic material having a refractive index of 1.2 to 2.0, thereby forming a mixture layer of the inorganic material layer and the powdery coating layer between the powdery coating layer and the substrate, and the optical contact can be improved between the patternwise powdery coating layer and the substrate, as described above. Furthermore, a phosphor screen with a good optical contact between the phosphor and the substrate and a good fluorescence transmissivity to the outer surface of the substrate can be provided according to the present process.

What is claimed is:

1. A process for improving an optical contact of a patternwise phosphor coating layer, which comprises forming a film of a photo-tackifiable composition comprising a water-soluble aromatic diazonium salt on the inner surface of a face plate of a color picture tube as a substrate; conducting at least one run of exposing the film to actinic radiation in a pattern and contacting the exposed film with phosphor, thereby depositing the phosphor on exposed parts of the film, so as to form a resulting patternwise phosphor layer, the phosphor being in the form of phosphor particles deposited on exposed parts of the film such that the resulting patternwise phosphor layer has voids; subsequent to forming the resulting patternwise phosphor layer, impregnating the resulting patternwise phosphor layer with a substantially transparent inorganic material having a refractive index of 1.2 to 2.0, to provide a layer of the substantially transparent inorganic material in the resulting patternwise phosphor, the substantially transparent inorganic material filling the voids of the resulting patternwise phosphor layer, so as to improve an optical contact between the substrate and the phosphor layer as compared with the optical contact between the substrate and the phosphor layer without the substantially transparent inorganic layer; aluminizing the patternwise phosphor layer; and baking the face plate having the phosphor layer.

2. A process according to claim 1, wherein the substantially transparent inorganic material is water glass.

3. A process according to claim 1, wherein the substantially transparent inorganic material having a refractive index of 1.2 to 2.0 is at least one substantially transparent inorganic material selected from the group consisting of oxides and hydroxides of Si, Zn, Al, In, Sn, Pb, Ti and Zr.

4. A process according to claim 1, wherein said substrate is transparent.

5. A process according to claim 1, wherein said phosphor has a refractive index of about 2.3.

6. A process according to claim 1, wherein the refractive index of the substantially transparent inorganic material is 1.2 to 1.8.

* * * * *